US006441569B1

(12) United States Patent
Janzow

(10) Patent No.: US 6,441,569 B1
(45) Date of Patent: Aug. 27, 2002

(54) PARTICLE ACCELERATOR FOR INDUCING CONTAINED PARTICLE COLLISIONS

(76) Inventor: Edward F. Janzow, 2671 Crone Rd., Dayton, OH (US) 45434

( * ) Notice: Subject to any disclaimer, the term of this patent is extended or adjusted under 35 U.S.C. 154(b) by 0 days.

(21) Appl. No.: 09/458,474

(22) Filed: Dec. 9, 1999

Related U.S. Application Data

(60) Provisional application No. 60/111,456, filed on Dec. 9, 1998.

(51) Int. Cl.[7] ..... H05H 13/00

(52) U.S. Cl. ..... 315/502; 315/111.01; 315/111.61; 313/359.1; 313/362.1; 313/62

(58) Field of Search ..... 315/502, 111.01, 315/111.61; 313/359.1, 362.1, 62

(56) References Cited

U.S. PATENT DOCUMENTS

| | | | | |
|---|---|---|---|---|
| 3,030,543 A | | 4/1962 | Luce | 313/161 |
| 3,155,592 A | | 11/1964 | Hansen et al. | 176/1 |
| 3,258,402 A | | 6/1966 | Farnsworth | 176/1 |
| 3,374,378 A | | 3/1968 | Courant | 313/63 |
| 3,386,883 A | | 6/1968 | Farnsworth | 176/1 |
| 3,530,497 A | | 9/1970 | Hirsch et al. | 176/1 |
| 3,532,915 A | | 10/1970 | Evrard | 313/63 |
| 3,664,920 A | | 5/1972 | Hirsch | 176/1 |
| 4,047,068 A | * | 9/1977 | Ress et al. | 313/359 |
| 4,112,306 A | | 9/1978 | Nunan | 250/499 |
| 4,139,777 A | | 2/1979 | Rautenbach | 250/499 |
| 4,189,346 A | | 2/1980 | Jarnagin | 176/5 |
| 4,202,725 A | | 5/1980 | Jarnagin | 176/5 |
| 4,298,805 A | | 11/1981 | Dennis | 376/111 |

FOREIGN PATENT DOCUMENTS

| | | | |
|---|---|---|---|
| EP | 338619 | 10/1989 | H05H/6/00 |
| EP | 362947 | 4/1990 | H05H/3/06 |
| EP | 362953 | 4/1990 | H05H/3/06 |
| EP | 340832 | 12/1993 | H05H/5/00 |
| EP | 645947 | 3/1995 | H05H/3/06 |
| EP | 394204 | 9/1995 | G21B/1/00 |
| 4,397,809 A | | 8/1983 | Salisbury 376/107 |

OTHER PUBLICATIONS

Takeshi, "Neutron Generator", Japanese Abstract of Publication No. 04147099 A, published May 20, 1992.

Hamm, Robert W., "Status of the LANSAR™ Neutron Generators" Jun. 1996.

AccSys Technology, Inc., "History of Linacs" Apr. 1998.

Miley, George H., "The IEC as a Complentary Neutron Source to Cf–252" 1997, pp. 287–297.

Physics Corporation "About MF Physics" Aug. 1998.

Miley, G.H., "Optimization Studies for an Inertial–Electrostatic–Confinement (IEC) Neutron Generator" Oct. 1996.

*Primary Examiner*—Bruce Anderson
*Assistant Examiner*—Nikita Wells
(74) *Attorney, Agent, or Firm*—Biebel & French

(57) ABSTRACT

A particle accelerator for inducing contained particle collisions. The particle accelerator includes two hollow dees of electrically conductive material which are separated and electrically insulated from each other. The dees are located between the poles of a strong magnet which generates a magnetic field through top and bottom sides of the dees. In addition, the dees are connected to an oscillator for providing an alternating voltage between the dees. The dees are located within a chamber containing a gas and/or vapor provided at a measurable pressure. Ions are accelerated in essentially spiral paths within the dees, and follow paths which may be both concentric and non-concentric with the dees whereby collisions are produced between accelerated ions and gas or vapor atoms contained within the chamber, as well as between pairs of accelerated ions following different paths. The particle collisions within the chamber produces neutrons, generates energy, and performs other useful functions associated with the interaction of particles.

18 Claims, 10 Drawing Sheets

U.S. PATENT DOCUMENTS

| | | | | |
|---|---|---|---|---|
| 4,397,810 | A | 8/1983 | Salisbury | 376/107 |
| 4,404,163 | A | 9/1983 | Bridges | 376/119 |
| 4,581,194 | A | 4/1986 | Givens | 376/119 |
| 4,638,216 | A | 1/1987 | Delaunay et al. | 315/111.81 |
| 4,639,348 | A | 1/1987 | Jarnagin | 376/107 |
| 4,757,237 | A | 7/1988 | Hellblom et al. | 315/111.81 |
| 5,013,969 | A | 5/1991 | Bach et al. | 315/61 |
| 5,075,522 | A | 12/1991 | Nardi | 200/148 R |
| 5,078,950 | A | 1/1992 | Bernaadet et al. | 376/116 |
| 5,103,134 | A | 4/1992 | Cluzeau et al. | 313/545 |
| 5,104,610 | A | 4/1992 | Bernardet et al. | 376/116 |
| 5,112,564 | A | 5/1992 | Bernardet et al. | 376/116 |
| 5,130,077 | A | 7/1992 | Bernardet et al. | 376/116 |
| 5,152,956 | A | 10/1992 | Bernardet et al. | 376/113 |
| 5,215,703 | A | 6/1993 | Bernardet | 376/114 |
| 5,293,410 | A | 3/1994 | Chen et al. | 376/108 |
| 5,745,536 | A | 4/1998 | Brainard et al. | 376/114 |
| 5,745,537 | A | 4/1998 | Verschoore | 376/114 |

* cited by examiner

PRIOR ART

PARTICLE ACCELERATOR FOR INDUCING CONTAINED PARTICLE COLLISIONS

RELATED PRIORITY APPLICATION

This application claims priority from provisional application Ser. No. 60/111,456, filed Dec. 9, 1998, which application is incorporated rein by reference.

BACKGROUND OF THE INVENTION

1. Field of the Invention

The present invention relates generally to particle accelerators and, ore particularly, to particle accelerators for producing collisions between particles contained within a predetermined system.

2. Related Prior Art

The present invention is related to the field of machines known as article accelerators and which include cyclotrons, microtrons, linear accelerators and inertial electrostatic confinement (IEC) machines. Following is a brief summary of the general characteristics of each of these prior art machines:

(a) Cyclotrons—a cyclotron 1 (see FIG. 1) is comprised of two semicircular hollow boxes, called "dees" 2, 4 which are formed of an electrically conductive material, such as copper, and which are arranged with the flat, open sides of the dees 2, 4 separated and facing each other. The dees 2, 4 are located in an evacuated chamber having a very high vacuum, and are located between the poles of a strong magnet, which generates an essentially uniform magnetic field passing through the flat faces, i.e. the top and bottom, of the dees 2, 4 and through the entire volume of the dees 2, 4. An alternating voltage is applied between the dees 2, 4. Ions or other charged particles, are introduced to the cyclotron at a central location between the dees 2, 4. The charged particle introduction or generation is controlled such that essentially all particles are accelerated to the maximum cumulative energy achievable by the particular cyclotron, and essentially all charged particles introduced or generated leave the acceleration chamber as part of the product beam. The paths of the charged particles within each dee 2, 4 are semicircles centered at the center of the acceleration chamber wherein each time a particular particle crosses between the dees 2, 4, it is accelerated to a higher energy, and the radius of its path is thereby increased to correspond to the higher energy, such that the paths of the particles within the cyclotron approximate a spiral. The dee to dee accelerating voltage is selected to be such that the increase in path radius resulting from each acceleration is great enough to provide spacing between the paths of particles which have undergone different numbers of accelerations, and thereby to prevent collisions of particles of one energy with those of greater or lesser energies.

(b) Microtrons—microtrons are machines which accelerate electrons in a vacuum chamber from which the accelerated electrons are extracted as a beam for use with an external target. The acceleration chamber of the basic circular microtron is in a magnetic field (similar to that of a cyclotron) which causes the electrons to move in circular paths. An electron generator and a radio frequency (i.e., microwave frequency) resonant cavity are located at a point near the wall of the circular acceleration chamber. Electrons from the generator are injected into the resonant cavity and accelerated by radio frequency energy. They leave the cavity and travel in a circular path wherein the magnetic field strength and microwave frequency are selected such that the length of the electrons circular path is an integral number of wavelengths at the selected frequency, such that the electron re-enters the resonant cavity in phase with the cavity frequency, and it is then again accelerated as it passes through the cavity. The next orbit of the electron is again circular, but has a greater radius than the first path, and has a total length which is a new and greater multiple of wavelengths. This sequence continues with the electron passing through the resonant cavity and being accelerated once each orbit, until the radius of the orbit is close to that of the acceleration chamber, at which time the electron is extracted from the chamber as part of a beam, and is directed to a target outside of the acceleration chamber. As with the cyclotron, microtrons operate with a high vacuum acceleration chamber and are provided with a single fixed location of charged particle generation.

(c) Linear Accelerators—linear particle accelerators use electric fields to accelerate charged particles in a straight line in a vacuum. The particles are generated at a fixed location at one end of an accelerator chamber and are accelerated in a beam into a target at the other end. Electrical and/or magnetic fields are used to prevent the charged particle beam from spreading out, which would normally occur due to electrical repulsion of the particles away from each other. Single or multiple acceleration stages may be used, and most machines employ multiple stages with accelerating voltages between stages. Further, most machines require very high voltages for acceleration.

(d) Inertial Electrostatic Confinement (IEC) Machines—IEC machines have been developed in two geometries, spherical and cylindrical. Both types have been used for neutron generation using deuterium—deuterium (D—D) and/or deuterium-tritium (D-T) reactions. The operating concept for the spherical type of the IEC machine includes providing a hollow electrically conductive outer spherical chamber, and a smaller spherical hollow grid formed of a conductive material which is centered within the spherical chamber. The chamber contains deuterium or a deuterium-tritium mix at a pressure somewhat less than about 2 mm Hg. A high DC voltage is applied between the outer chamber and the grid, with the grid being negatively charged. The voltage is high enough to cause breakdown of the gas within the chamber, creating ions and/or plasma. IEC machines typically use voltages ranging from 16,000 to about 40,000 volts, with higher voltages being desirable. The positive deuterium and/or tritium ions are accelerated radially inwardly toward the negatively charged grid, where they reach maximum energy, pass through holes in the grid, and travel across the space inside the grid at constant speed, after which they pass out of the grid through holes in the opposite side. At this point, the positively charged ion is traveling toward the positively charged outer sphere, which repels it. The ion is slowed to zero radial velocity and is then re-accelerated toward the negatively charged grid. The cycle repeats indefinitely until the ion impacts another ion, a non-ionized gas atom, or a solid part of the grid sphere. Neutrons are generated from ion—ion and ion-gas collisions. The ion energies and electrical fields are such that ions cannot reach the outer sphere, so that the surface of this sphere cannot be used as a target.

The cylindrical IEC machine is similar to the spherical IEC machine in principle and consists of a conductive tube and two slightly concave conductive reflectors, one at each end of the tube and separated from the tube by a predetermined distance. The operative elements of the machine are enclosed in a chamber which contains deuterium or a mixture of deuterium and tritium at a pressure similar to that used in the spherical IEC machine. High voltage sufficient to cause gas breakdown is applied between the tube and the reflectors, with the tube negative and each reflector positive, to cause the gas to break down and produce ions in the regions between the tube and the reflectors. The ions are initially accelerated toward the negatively charged tube, pass through it, and are slowed and then reversed and re-accelerated back toward the tube by the reflector. The ions continue to travel back and forth through the tube until they collide with another ion or neutral gas atom. Both IEC machines accelerate ions by single stage electrostatic means, which requires very high voltage. For example, to accelerate a deuteron to a maximum energy of 22 Kev, 22,000 volts must be applied between the outer sphere and the grid in the spherical IEC machine, or between the tube and reflectors in a cylindrical IEC machine.

While the above described machines provide effective means for accelerating particles to perform their desired functions, there exists a continuing need for a particle accelerator machine which is capable of operating at lower voltages than prior art machines and is capable of performing work by inducing particle-to-particle collisions within the machine, including production of neutrons and to produce energy as a result of such collisions, as well as other useful operations which may be obtained through collision of particles therein.

SUMMARY OF THE INVENTION

The present invention is configured with essentially the same physical components as that of a cyclotron in that the present invention includes two hollow dees of electrically conductive material which are separated and electrically insulated from each other with the flat, open sides of the dees facing each other. The dees are located between the poles of a strong magnet which generates an essentially uniform magnetic field through the flat faces, i.e. the top and bottom, of the dees. In addition, the dees are connected to an oscillator for providing an alternating voltage between the dees.

The dees for the particle accelerator of the present invention are located within a chamber wherein the chamber contains gaseous deuterium (hydrogen-2) or tritium (hydrogen-3), or a mixture of the two, provided at a measurable pressure. Further, other gases, in addition to or in place of deuterium or tritium, may be provided to the chamber. Thus, in a broad aspect of the present invention, the particle accelerator disclosed herein differs from a cyclotron in that a cyclotron requires an evacuated chamber, and the present invention purposefully provides a gas filled chamber for reasons to be described below.

In a further aspect of the invention, ions are introduced to the chamber for acceleration within the hollow areas defined by the dees. Specifically, an ion introduced into the area between the dees will have a positive charge and will be attracted to the negatively charged dee, and therefore will be accelerated toward this dee. Once the ion enters the dee, it will no longer "see" the electric field and will move at a constant speed, but will travel in a circular path due to forces caused by the magnetic field. By the time the ion has traveled half a circle and moves toward the opposite dee, the voltage between the dees will have been reversed, so that the opposing dee is now negatively charged to again accelerate the ion. Due to the increasing speed of the ion, the ion will follow an essentially spiral path of increasing radius.

In an important aspect of the present invention, ions may be formed within the chamber from the gas contained therein, and additionally may also be fed to the chamber from an outside source. Production of the ions may be accomplished by spaced electrodes located between the dees and defining an electrical potential to ionize gas therebetween. As the ions are accelerated in spiral paths within the dees, they will collide with non-ionized deuterium and/or tritium atoms within the acceleration chamber, and with other deuterium and/or tritium ions, whether accelerated or not. As a result of deuterium—deuterium (D—D) and/or deuterium-tritium (D-T) collisions and the resultant nuclear reactions, and in accordance with an aspect of the present invention, neutrons will be generated. Further, in addition to the targets provided by the atoms and ions moving within the chamber, additional targets may be deuterium and/or tritium atoms affixed to the surfaces of the chamber by chemical means (such as hydrides), by surface adsorption or absorption and/or by collision induced absorption.

In accordance with an additional aspect of the invention, ions are produced at locations other than adjacent to the geometric center of the device, for example, through collision of ions with neutral atoms to form additional ions. Thus, it is an object of the present invention to provide ions following paths which are not concentric with each other, whereby collisions between accelerated ions will occur of sufficient energy to cause nuclear reactions between the colliding particles.

In a further aspect of the invention, the particle accelerator may be configured as an ion pump or low pressure gas pump. In such a configuration, each of the dees would be provided with one or more tubes wherein each tube is attached with its axis tangential to the respective dee. The tubes on one dee are positioned such that neutral atoms which are struck by accelerated ions are "knocked" into the tube openings, and the tubes attached to the other dee are positioned such that struck atoms are propelled away from the opening, decreasing the number of atoms in this region and thus reducing the pressure to induce a gas flow through the tube into the chamber. In this manner, the atoms contained within the particle accelerator may be replenished to avoid depletion of the target atoms during operation of the particle accelerator.

In a further aspect of the invention the particle accelerator may be used as a gas separator/purifier wherein a mixture of gases is provided to the particle accelerator and, for a specific magnetic field strength, the frequency of the alternating voltage applied across the dees is selected such that the ions of one of the gases will have the correct charge-to-mass ratio to be accelerated each time they cross the dees, whereas the ions having other charge to mass ratios will not be accelerated within the chamber. The accelerated ions will eventually be accelerated to the outer perimeter of one of the dees having an exit tube whereby the accelerated ions may be selectively extracted from the chamber.

In accordance with a further aspect of the invention, modifications to the configuration and spacing of the dees may be provided in order to enhance the number of head-on and near-head-on collisions between particles as they travel between the dees as well as modifications to direct accelerated ions to paths of travel between the outside perimeter of the dees and the inside surface of the gas containing chamber in order to permit the accelerated ions to travel for an extended time to increase the probability of a collision between the ion and an atom contained within the chamber.

Other objects and advantages of the invention will be apparent from the following description, the accompanying drawings and the appended claims.

DETAILED DESCRIPTION OF THE PREFERRED EMBODIMENT

Figure 1:
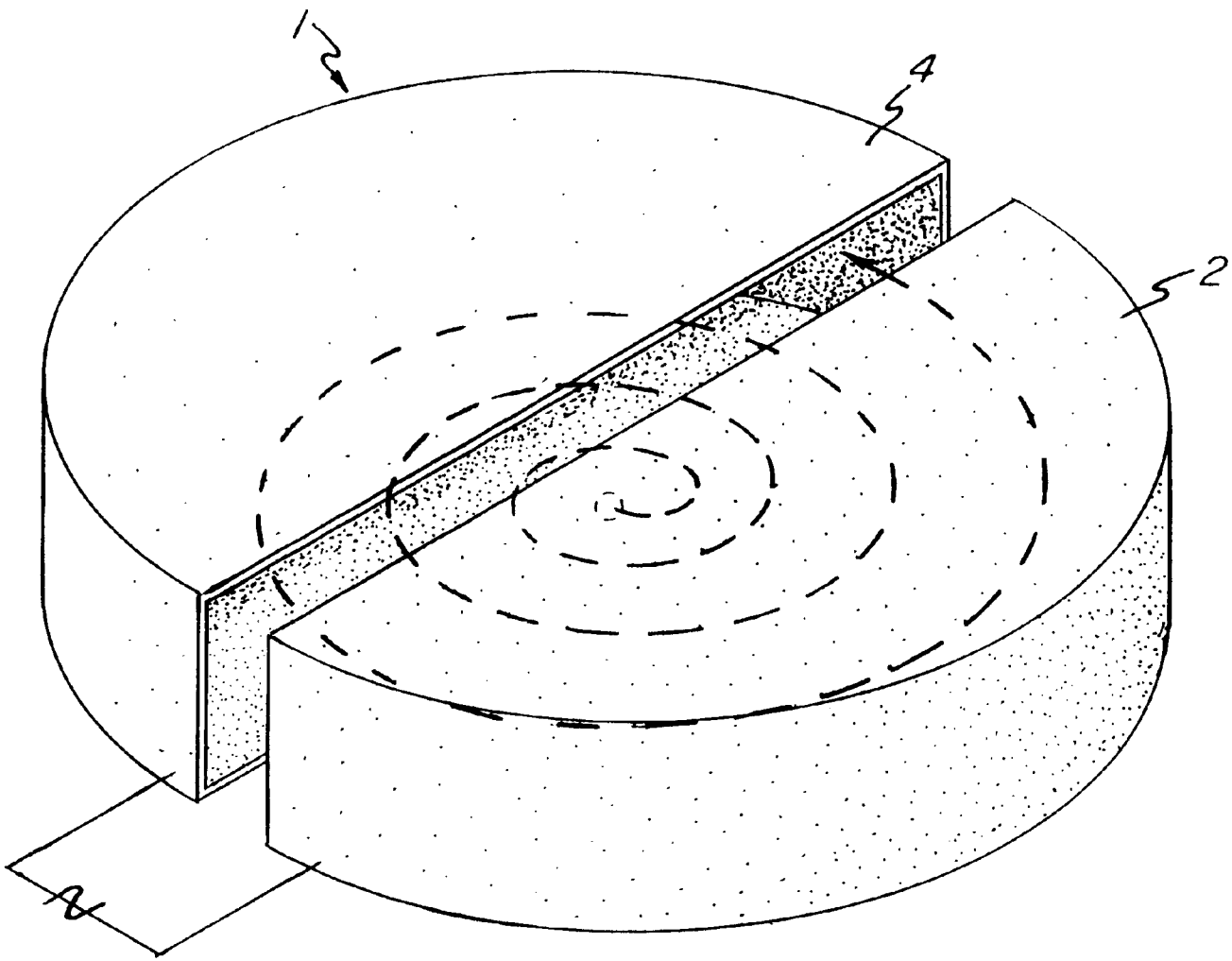
FIG. 1 is a perspective view of a prior art cyclotron.
Figure 2:
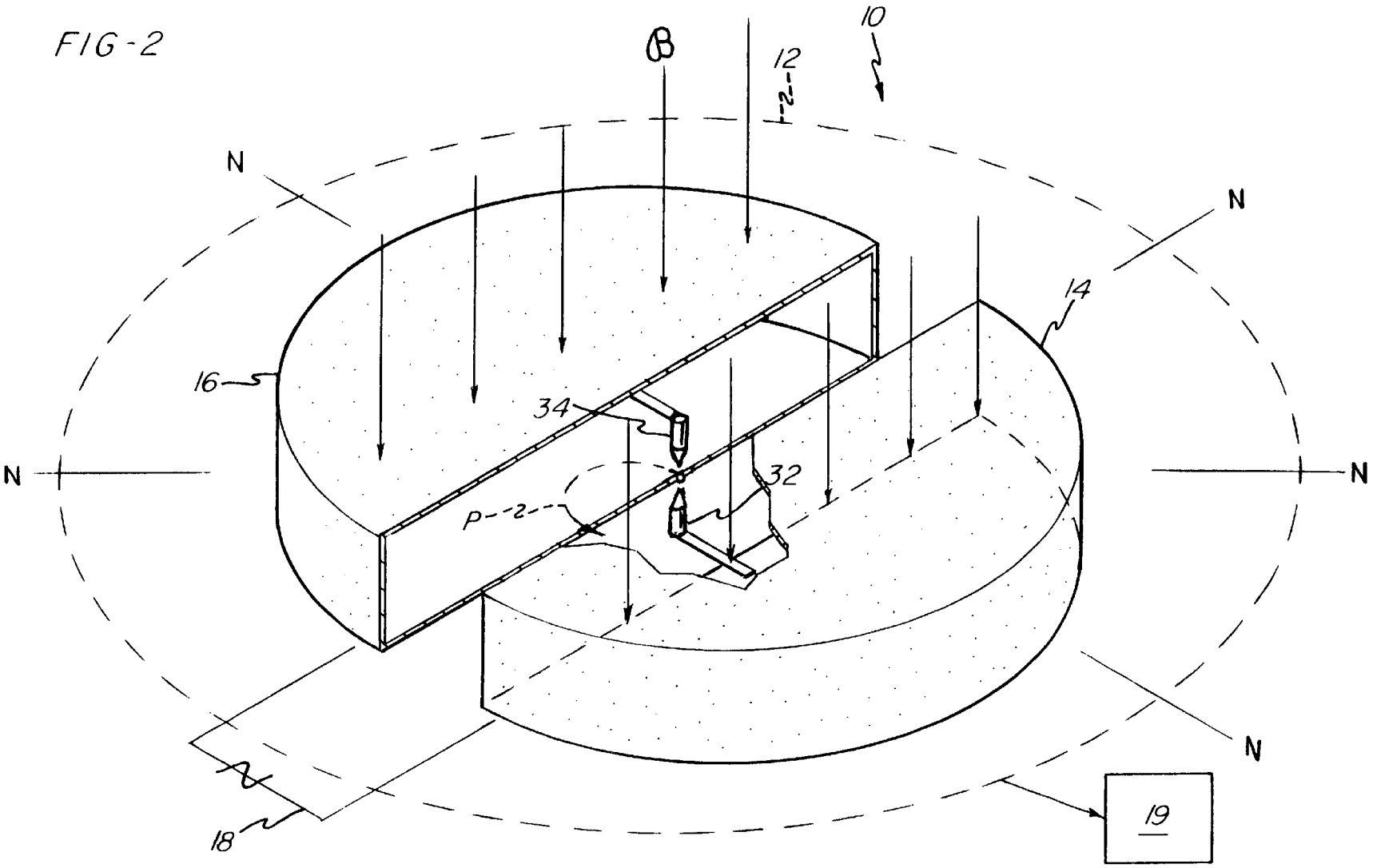
FIG. 2 is a perspective view of an embodiment of the present invention.

Referring to FIG. 2, the basic structure of the particle accelerator 10 for carrying out the present invention is illustrated and includes a chamber, illustrated diagrammatically by broken line 12, defining a contained area containing first and second portions comprising two hollow dee members 14 and 16 facing each other in spaced relation. The dees 14, 16 define a generally circular area and are preferably formed of a conductive metallic material. In addition, an oscillator 18 is connected to the dees 14, 16 for providing an alternating polarity voltage to the dees 14, 16.

Figure 3:
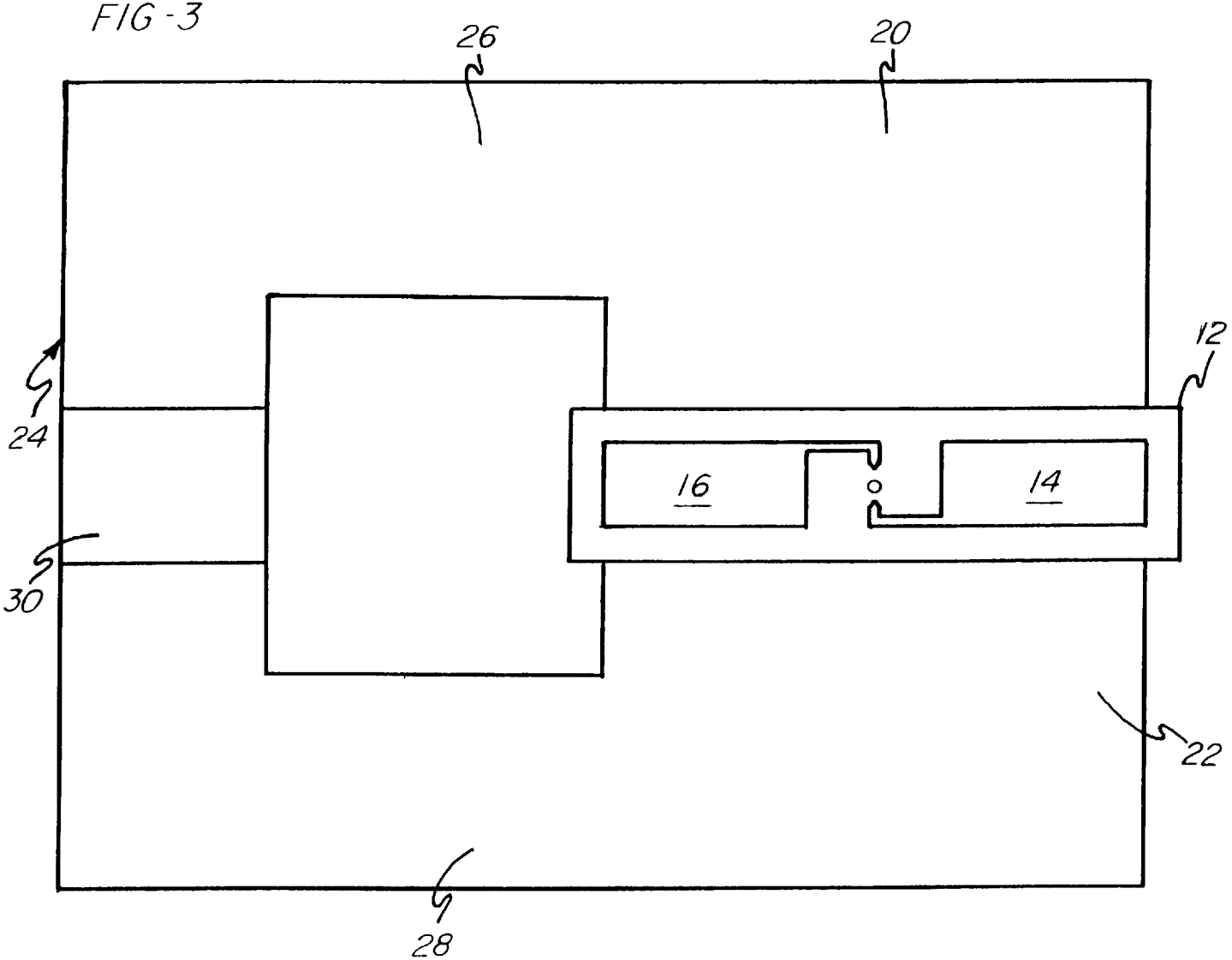
FIG. 3 is a side elevational view of the device of FIG. 2.

Referring additionally to FIG. 3, the chamber 12 is located between opposing poles 20, 22 of a magnet structure 24 whereby a uniform magnetic field B passes through the dees 14, 16. The poles 20, 22 of the magnet structure 24 are supported on respective arms 26, 28 which extend to a magnet 30 and wherein the arms 26, 28 form magnetic conductors, typically formed of an alloy such as an iron-silicon alloy for conducting the magnetic force to the area of the poles 20, 22. The magnet 30 may be either a strong permanent magnet or an electrically powered magnet, or a plurality of such magnets.

The dee 14 includes a first electrode 32 electrically connected to dee 14, and the second dee 16 includes a second electrode 34 electrically connected thereto. The electrodes 32, 34 are generally centrally connected between the dees 14 and 16 and are spaced from each other so as to permit arcing between the electrodes 32, 34 when voltage is applied by the voltage oscillator 18 to the dees 14 and 16.

The chamber 12 is filled with a gas or vapor comprising deuterium (D) and/or tritium (T) at a measurable pressure. Further, other gases, in addition to or in place of deuterium or tritium, may be provided to the chamber 12. It should be noted that in this respect, the apparatus 10 of the present invention differs from a conventional cyclotron in that a cyclotron operates in an evacuated chamber. Further, the provision of electrodes 32, 34 in the present invention operates to form an arc between the electrodes 32, 34 when voltage is applied to the dees 14, 16 by the voltage oscillator 18 wherein arcing between the electrodes 32, 34 produces deuterium ions, or depending on the particular gas within the chamber, other ions, from the gas present within the chamber. The ions are accelerated by the voltage difference between the dees 14, 16 in accordance with conventional cyclotron principles, and follow a spiral path P of increasing radius as they travel through the dees 14, 16.

Figure 2A:
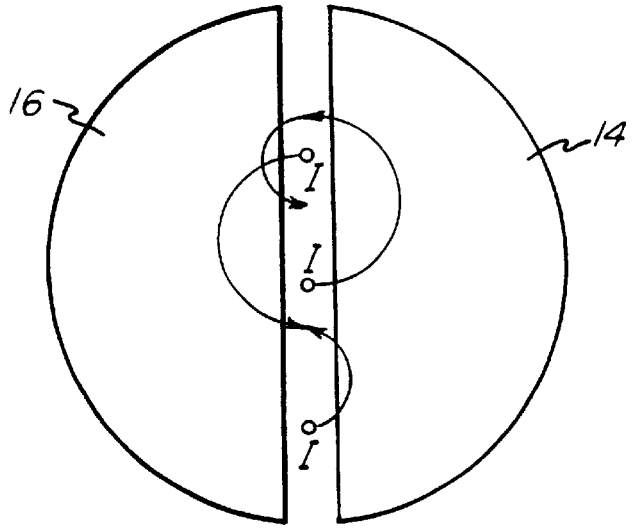
FIG. 2A is a top plan view illustrating different path centers for ions formed in different parts of the chamber for the device, and showing head-on collisions between ions.

Additionally, in further contrast to conventional cyclotron operation, the ions produced within the present apparatus 10 will impact other atoms, such as deuterium, tritium or other gas or vapor atoms, during the accelerated travel of the ions causing formation of additional ions, which ions are then also accelerated within the area of the dees 14, 16. Thus, it should be understood that there will be numerous ions accelerated in essentially spiral paths which are not concentric with the dees 14, 16 and which will result in head-on and near head-on collisions, as is illustrated by the arrows in FIG. 2A depicting the paths of travel of various ions I. These collisions between the accelerated ions and neutral atoms and/or other ions operate to produce nuclear reactions releasing neutrons N as well as energy in the form of heat, which heat may be extracted to a separate device 19 to perform work.

Accordingly, it should be understood that a primary object of the present invention is to produce collisions between ions and other atoms and/or ions within the chamber 12 for the production of neutrons and energy. To this end, it is necessary to provide a measurable amount of a gas, such as deuterium and/or tritium or other gas or vapor, within the chamber 12 in order for the particle accelerator apparatus 10 to perform its designed function. In addition to providing gas atoms within the chamber 12 as targets for producing nuclear reactions, additional targets, such as deuterium, tritium or other atoms, may be affixed to the surfaces of the dees 14, 16 and/or to the interior wall of the chamber 12 by chemical means, such as by hydrides, by surface adsorption or absorption and/or by collision induced absorption. In any case, it is the intended purpose of the invention to provide acceleration of ions through provision of an alternating voltage between the dees 14, 16 of the apparatus, and to guide the path of travel of the ions by a magnetic field B in order to guide the path of the ions in a circular generally increasing spiral whereby a controlled acceleration of the ions is provided within a relatively compact area resulting in nuclear reaction producing collisions between the ions and atoms within the apparatus 10 in a manner not heretofore provided by prior art devices.

It should be understood that since the object of the present invention is the production of collisions between particles resulting from interactions of accelerated ions with neutral atoms or other ions, rather than production of an extracted beam or stream of accelerated high energy particles, the voltage requirements for the present particle accelerator is greatly reduced as compared to operation of a cyclotron. For example, the actual alternating voltage applied across the dees, which is not fixed by the equations describing the system requirements for obtaining a sufficient "maximum acceleration voltage" to obtain significant neutron generation, may be on the order of hundreds of volts, which is substantially lower than voltages required for conventional particle accelerators, such as a cyclotron which generally operates with voltages on the order of thousands of volts.

The number of revolutions traveled by an ion starting near the center of the chamber will be $n=V/2E$, where E is the alternating voltage across the dees and V is the maximum acceleration voltage, and the maximum acceleration voltage V is proportional to the square of the magnetic field strength and the square of the radius of the chamber. Thus, with a lower dee-to-dee voltage, the number of revolutions n of an ion before it reaches the chamber wall will be greater, and with the greater number of revolutions, there will be a corresponding increase in the probability of a collision between the ion and another particle.

In a typical design, an alternating dee-to-dee voltage of 400–500 volts may be provided to a particle accelerator having an ion acceleration area with a diameter on the order of 3 to 6 inches and a magnetic field strength on the order of 8,000 to 16,000 gauss, with an alternating voltage frequency on the order of 6.1 MHz. Such a design should produce deuteron kinetic energies on the order of greater than 22 Kev, which energy should provide significant energy and neutron generation.

Figure 4:
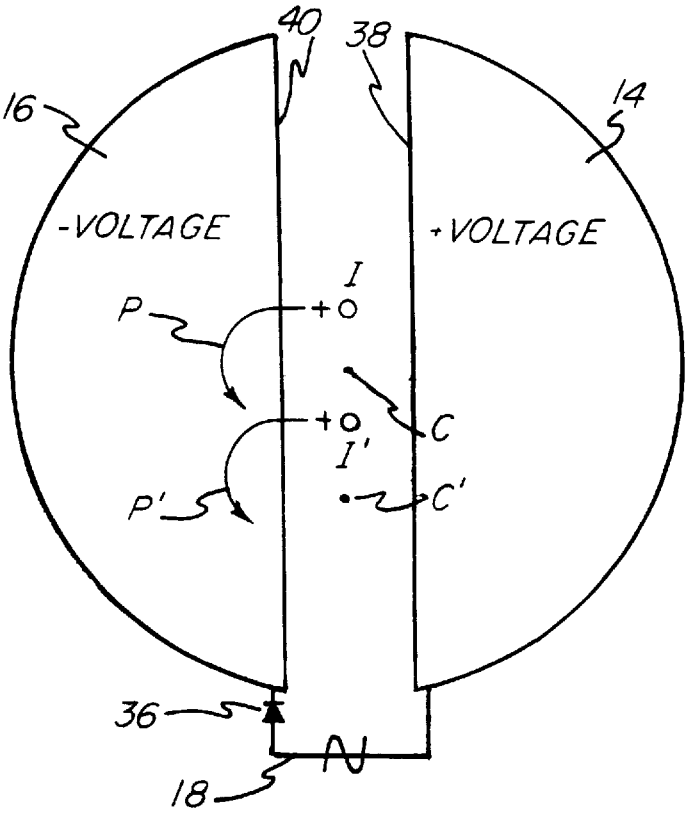
FIG. 4 is a top plan view illustrating different path centers for ions formed in different parts of the chamber for the device, and a modification to the device of FIG. 2.

Referring to FIG. 4, the particular location of the electrodes, 32, 34 for producing ions is of importance in that the location of the electrodes 32, 34 will affect the starting point for the path of the ions as they spiral through the ion acceleration area defined by the dees 14, 16. It is preferable that a substantial quantity of ions follow a path having a path center at a geometric center of the configuration defined by the dees 14, 16. For example, the ion I is shown with a path initiated above the geometric center C for the dees 14, 16 whereby the path P of the ion I will be centered about the point C, resulting in the ion I following as long a path P as possible and completing a maximum number of revolutions through the dees 14, 16 before reaching the outer walls of the dees 14, 16. Conversely, the ion I' with a path P' initiating on the opposite side of the center C from the ion I will have a center C' displaced from the center C of the dee configuration, resulting in the ion I' following a path P' which travels fewer revolutions before contacting one of the walls of the dees 14, 16 than the ion I. Accordingly, to minimize the production of ions I', it is desirable to somewhat displace the location of the electrodes 32, 34 such that the paths of the ions are substantially centered about the geometric center C for the dee configuration, and to only accelerate the ions in a direction from the right dee 14 to the left dee 16, which may be accomplished by inserting a diode 36 in the alternating voltage source 18. The addition of the diode 36 would reduce the ion production within the chamber 12 to approximately half the level normally available if ions were produced by energizing the electrodes 32, 34 each time the ions cross the gap between the dees 14, 16 in either direction. Also, it should be understood that limiting the production of the ions I' would not necessarily be desirable in all applications and would most likely be applicable to those applications where it is desirable to limit the number of impacts and generation of heat at the outer walls of the dees 14, 16.

The selection of the alternating voltage applied to the dees 14, 16 will be controlled by factors relating to the desired acceleration of the ions each time they pass between the dees 14, 16, as well as factors related to conditions producing arcing between the facing edges 38, 40 of the dees 14, 16. In the operation of the present invention, it may be desirable under certain conditions to provide a sufficient voltage to produce arcing around the entire peripheral facing edges 38, 40 in order to produce ions. In addition to the voltage applied across the dees 14, 16, such arcing would be affected by the properties of the gas provided within the chamber 12, the pressure and temperature of the gas within the chamber 12, the shortest distance between the facing edges 38, 40 of the dees 16, 14, as well as the shape and character of the edges 38, 40 of the dees 14, 16. However, in the preferred embodiment, it is believed that the optimum operating mode for the particle accelerator 10 is one in which the maximum dee-to-dee alternating voltage is less than that which would cause ionization of the gas as a result of arcing between the dees.

Figure 5:
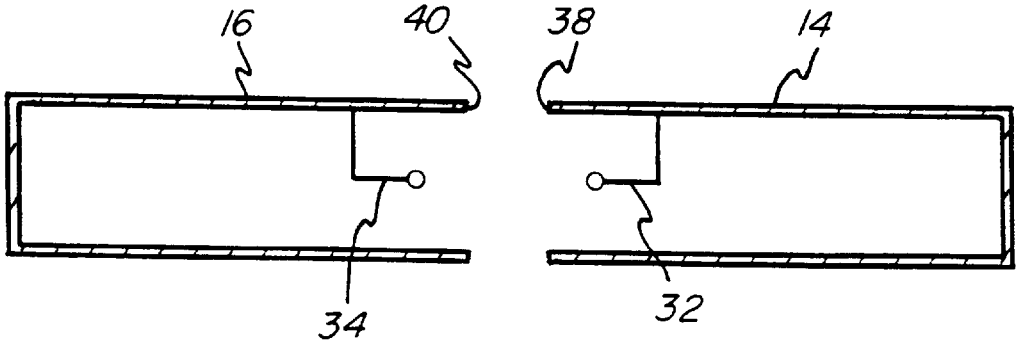
FIG. 5 is a side elevational cross-sectional view of an alternative embodiment of the present invention.

With further reference to the relationship between arcing and the gas pressure provided within the chamber 12, it should be noted that the above discussion in relation to arcing between the electrodes 32, 34 is based on an operating pressure within the chamber 12 of approximately 2 mm Hg and greater. Further, it should be understood that for pressures below 2 mm Hg, and assuming a constant electrode spacing, there is a sharp increase in required voltage to produce arcing as the pressure is decreased, and there is a sharp increase in voltage required for arcing as the pressure times electrodes spacing decreases. This implies that for pressures below 2 mm Hg, the ionizing electrode spacing must be greater than the spacing between the facing edges 38, 40 of the dees 14, 16. This can be accomplished by placing the ionizing electrodes inside of the dee cavities, as is illustrated in FIG. 5 wherein dee spacing between the electrodes 32' and 34' is shown greater than the gap between the edges 38 and 40 of the dees 14, 16. In such a configuration, it is contemplated that local insulators may be required to preclude breakdowns between one electrode and the opposing dee, and that the particular shape of the electrodes 32', 34' will likely also influence the minimum voltage required for arcing between the electrodes 32', 34'.

As an alternative embodiment, the ionizing electrodes 32, 34 may be configured such that they are not electrically connected to the dees. Electrical separation of the electrodes 32, 34 from the dees would permit the ionizing electrodes 32, 34 to be operated at higher or lower voltages than the dees 14, 16, as well for different time lengths, including continuously, in order to provide the desired control over ionization of the gas contained within the chamber 12.

Figure 6:
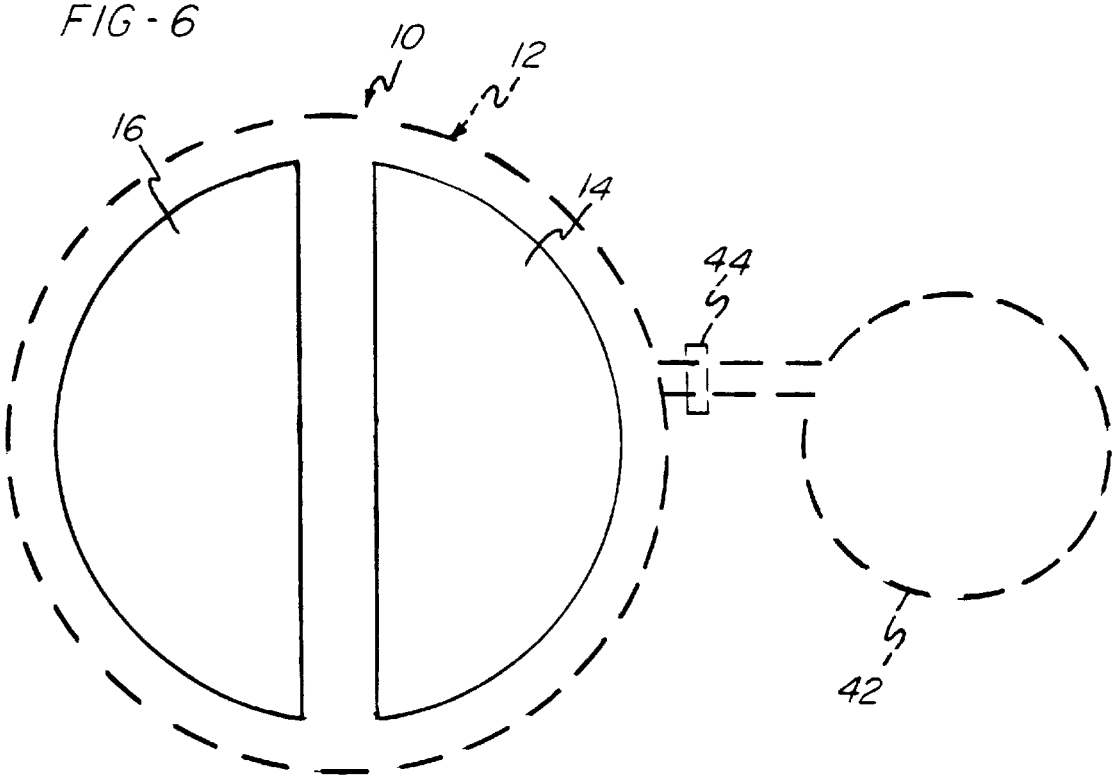
FIG. 6 is a top plan view of an alternative embodiment of the present invention including a gas reservoir.

During operation of the apparatus 10, the gas within the chamber 12 may become depleted after a certain period of time, such that there are fewer targets, i.e., deuterium atoms, for impact with accelerated ions within the chamber. In order to provide a pressure adjustment, a gas reservoir 42 (see FIG. 6), such as a reservoir filled with deuterium may be provided connected to the chamber 12. The gas reservoir 42 may be connected with or without a pressure regulator 44, and the reservoir 42 may be provided for both maintaining a desired pressure within the reaction chamber 12 and to replenish depleted gas atoms.

As previously noted, in addition to the gas contained within the chamber 12, additional targets for reacting with the accelerated ions may be provided on the surfaces of the chamber, and will typically comprise a metal layer containing deuterium and/or tritium. Further, in contrast to prior art devices, such as linear accelerator type neutron generators, the target provided by the surfaces of the chamber 12, as well as the dees 14, 16 comprises a much larger surface area such that the surfaces of the present invention are less subject to the erosive and heating effects resulting from impact of the ions. Further, as was previously mentioned, the present device constructively extracts heat resulting from the nuclear reactions to use the heat energy to perform work in a separate device 19, or otherwise extract the heat to maintain the device 10 at a desired temperature.

Figure 7:
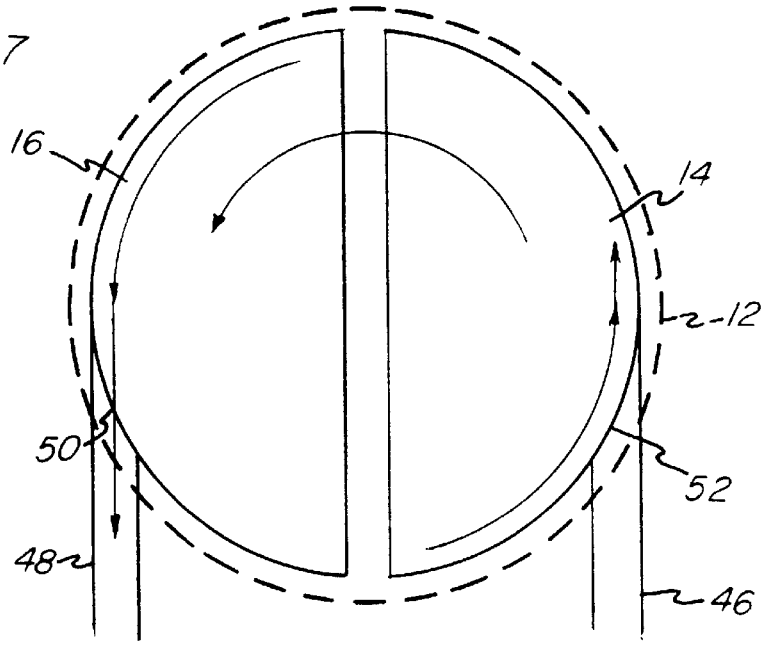
FIG. 7 is a top plan view of an alternative embodiment of the present invention comprising a gas pump.

Referring to FIG. 7, an alternative embodiment of the present invention is illustrated wherein the particle accelerator is configured as an ion pump. In this embodiment, each dee 14, 16 has a tube 46, 48 attached tangentially to the perimeter thereof. The tube 48 is positioned such that neutral atoms which are struck by accelerated ions are "knocked" into the tube opening 50, and the tube 46 attached to the dee 14 is positioned such that atoms struck within the dee 14 are propelled away from the opening 52 of the tube 46. The device is operated in the same manner as described above and generates relatively high energy ions, with the highest energy ions being closed to the chamber perimeter. Some of the ions will be ionized as a result of a collision with an accelerated ion, however, other atoms will not be ionized and those which are struck near the opening 50 of the tube 48 and which remain neutral will not be affected by the magnetic field and will therefore travel out of the dee 16 and into the tube 48. In addition, means (not shown) may be provided for electrically deflecting accelerated ions and atoms ionized by impact near the tube opening 50 to cause these particles to also enter the tube 48.

As a result of random motion of gas atoms at the opening 52 of the tube 46, some of the gas in tube 46 will enter the dee 14 and will be impacted by moving ions or atoms, resulting in the gas atoms being propelled away from the tube opening. This activity near the tube opening 52 results in a reduced pressure at the opening 52, and thereby causes gas within the tube 46 to be drawn toward the opening 52 and into the dee 14.

The configuration of FIG. 7 may be used in conjunction with a gas reservoir supplying gas through the tube 46. As a result of the flow produced by this configuration, mixing of gas from the reservoir with the atoms located in the dees 14, 16 is assured to optimize the distribution of deuterium atoms for colliding with ions in neutron-producing reactions.

Figure 8:
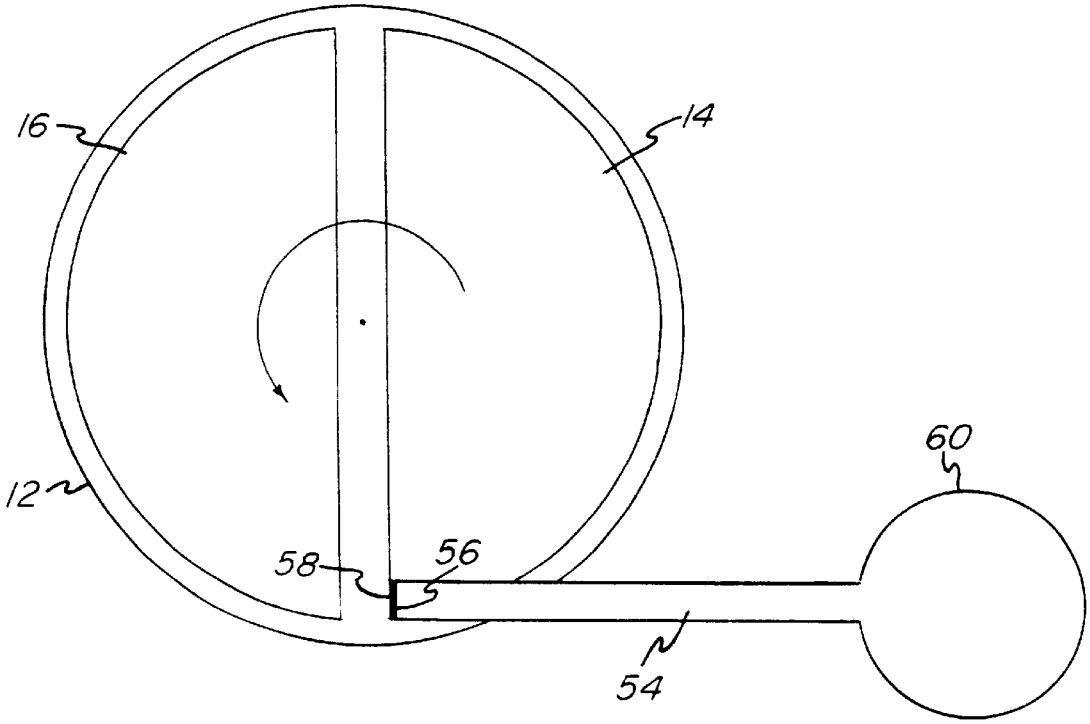
FIG. 8 is a top plan view of an alternative embodiment of the present invention comprising a gas separator.

Referring to FIG. 8 a further configuration for the particle accelerator is shown which is designed for separating high energy ions within the accelerator from the significantly lower energy ions and the neutral gas atoms in the chamber. In this configuration, an exit tube 54 is positioned tangential to a side of the dee 14 and facing the dee 16, including an opening 56 facing toward oncoming ions. In addition, the opening 56 is covered with a thin window 58 which preferentially permits passage of high energy ions, and which prevents passage of lower energy ions and non-accelerated atoms. For example, the thin window 58 may be formed of a thin sheet of Mylar. The tube 54 leads to a collection chamber 60 for collecting the preferentially separated ions.

In a practical application of the embodiment of FIG. 8, the chamber 12 may be provided with two or more different gasses. The frequency of the alternating voltage applied across the dees 14, 16 is selected such that ions having a specific charge-to-mass ratio will travel a path which is one-half a circle in the time it takes the voltage cross the dees to change from positive to negative or vice versa. The ions having the correct charge-to-mass ratio will be accelerated each time they cross between the dees, and may reach the maximum energy capability of the machine. On the other hand, ions having other charge-to-mass ratios will cross the dees at the wrong time to be properly accelerated and may in fact be decelerated as they cross between the dees. Thus, the selected gas molecules will be accelerated to the outer periphery of the dees 14, 16 and will pass through the window 58 into the tube 54 and to the collection chamber 60, while the remaining gases will be at a significantly lower energy and will remain within the chamber 12. In this manner, this configuration of the invention may be used as a gas separator or purifier.

Referring to FIGS. 9–12, additional embodiments are illustrated which permit ions, having path radii nearly equal to the outside radius of the dees 14, 16 to leave the region inside the dees and enter a region outside of the dees 14, 16 where the target gas is present and a strong magnetic field is also present so that the ions will continue to travel in circular paths. However, in the region between the dees 14, 16 and the surrounding wall of the chamber 12, no electrical acceleration will occur. In this region, ions will continue to move at a constant speed until they impact a gas atom or ion resulting in a reaction, or they will undergo other interactions which reduce their energy without a reaction.

It should be noted that only the ions which are generated near the center of the dees and which have nearly attained the maximum possible machine energy can have path radii near that of the dees 14, 16. Such high energy ions have the highest reaction cross section of any in the machine, and increasing their path-length through the target gas (outside the dees) will increase the reactions per ion accelerated ratio, and thereby the neutron output, with no increase in input power.

Figure 9:
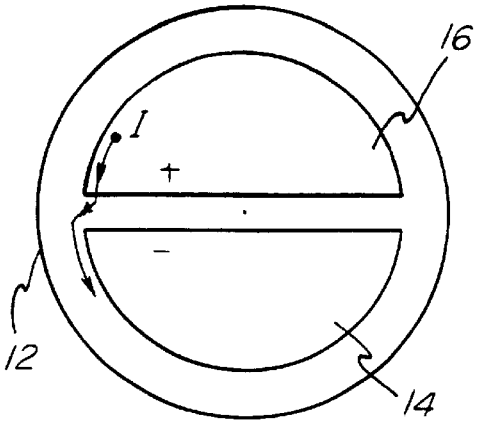
FIG. 9 is a top plan view illustrating an alternative mode of operation of the present invention.

Referring to FIG. 9, a particle accelerator is shown wherein an ion I is traversing and being accelerated through the gap from the dee 16 to the dee 14 and wherein the radius of the path of the ion I is great enough such that the additional acceleration will increase its radius of travel to that which is greater than the radius defined by the dees 14 and 16. Assuming that the wall of the dees is very thin, the ion will move outside the radius of the dees and will pass the face of the dee 14 on the outside of the dee 14. Thereafter, if the outside surfaces of the dees 14, 16 are electrically insulated, the ion I will no longer be affected by the accelerating voltages, and will tend to travel in a circle at constant speed until it undergoes an interaction with a gas atom or another ion.

Figure 10:
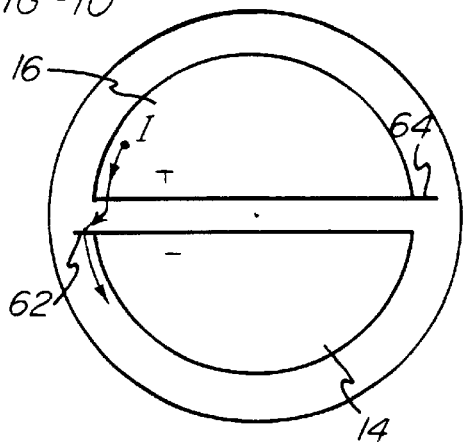
FIG. 10 is a top plan view illustrating a further embodiment based on the mode of operation of FIG. 9.

Referring to FIG. 10, a modification of the configuration of FIG. 9 is illustrated. In the configuration of FIG. 10, a grid 62, 64 is associated with each of the dees 14, 16 wherein the grids 62, 64 are sized to be approximately as wide as the increase in the radius of the path of the ion I on its last acceleration through the gap between the dees 14, 16. The purpose of the grids 62, 64 is to provide acceleration voltage outside the dees for the final acceleration, so that this acceleration will achieve the full dee-to-dee potential, and the grids 62, 64 are preferably formed with a large proportion of this area as open spaces so that most ions approaching the grids 62, 64 will pass therethrough.

Figure 11:
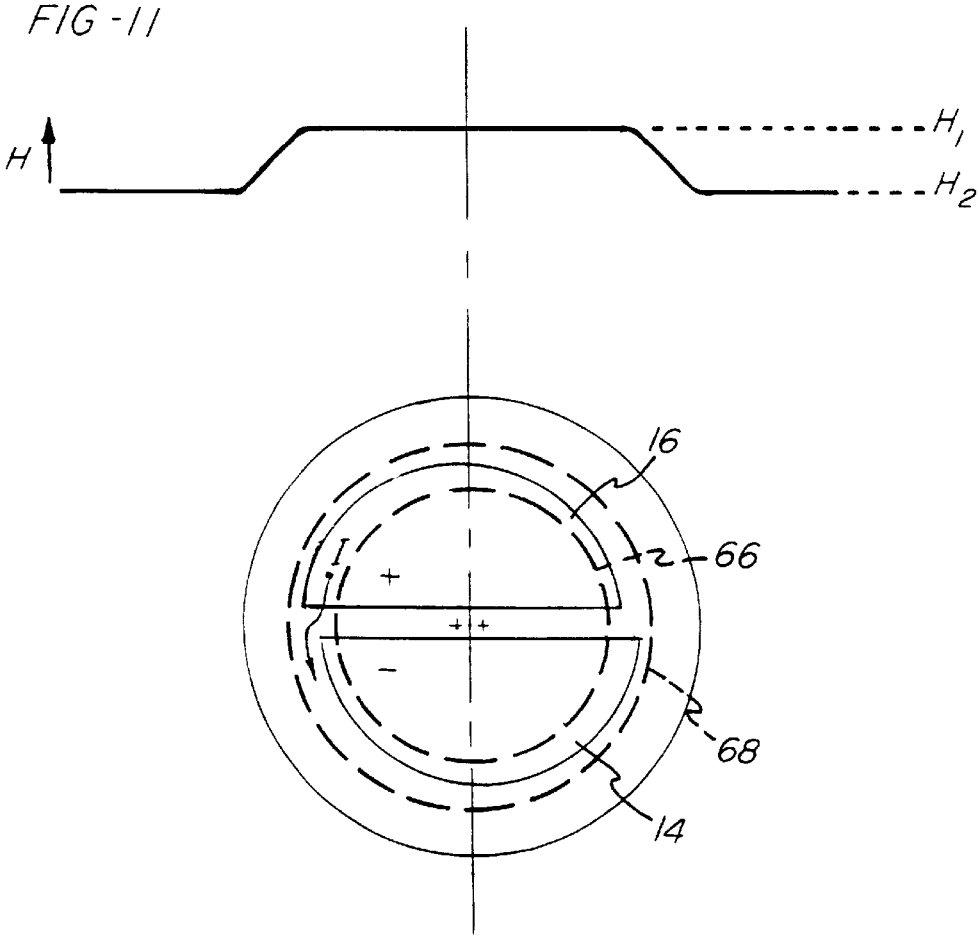
FIG. 11 is a top plan view illustrating a further embodiment based on the mode of operation of FIG. 9.

Referring to FIG. 11, a further alternative configuration is illustrated wherein the dees 14, 16 are offset relative to each other to facilitate forming an output gap for the high energy ions to pass outwardly of the dees 14, 16. In addition, a varying magnetic flux density is also provided to facilitate directing the ions to a path outside of the dees. In particular, a constant and uniform magnetic flux density is provided inside a circular region within both dees 14, 16, as shown by dashed circle 66 to provide a magnetic flux density $H_1$. Between the dashed circle 66 and an outer dashed circle 68, the magnetic flux density decreases, and beyond the larger dashed circle 68 the magnetic flux density is again constant at a lesser intensity $H_2$. As an ion I enters the region of decreasing magnetic flux density defined between the circular areas 66 and 68, its path radius will increase sufficiently, as it travels through an arc of 180° after its last acceleration, such that it passes out of the dees at the dee offset. Thereafter, the path radius continues to increase until it enters the outer region of uniform, decreased magnetic flux density $H_2$. In the region of flux density $H_2$, the ion I will travel with constant speed and with a path radius determined by its energy after the last acceleration and by the magnetic flux density $H_2$ until a collision with another ion or atom occurs.

It should be understood that an alternative to the embodiment of FIG. 11 could provide $H_3$ as a stronger magnetic flux density than the magnetic flux density $H_2$ in a region of greater radius than that of $H_2$, but still inside the acceleration chamber. In this configuration, impacts of ions with the inside walls of the acceleration chamber 12 may be lessened in that ions approaching the walls of the chamber would enter a region of increasing magnetic flux density and would therefore be deflected to a smaller path radius.

Figure 12:
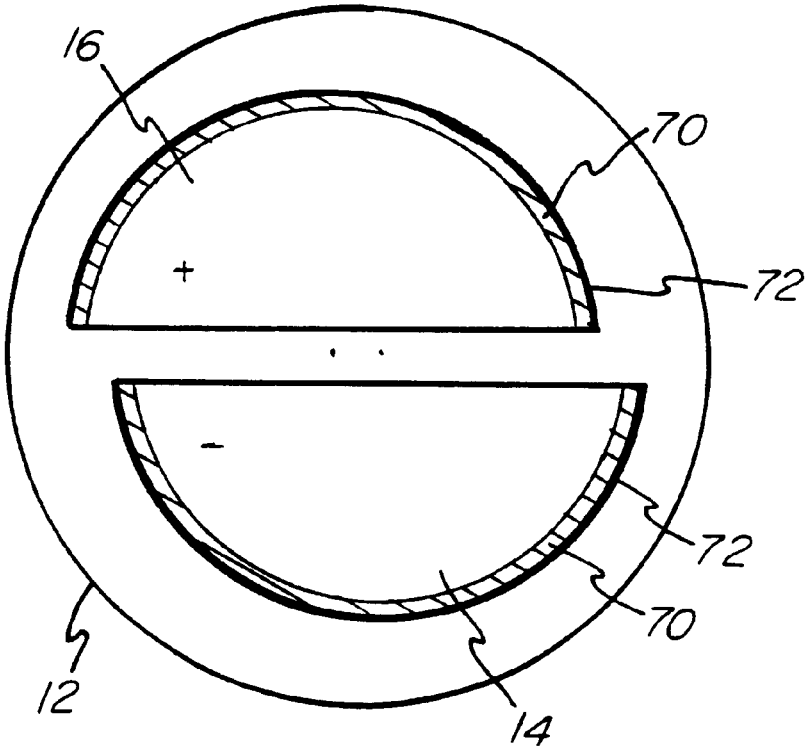
FIG. 12 is a top plan view illustrating a further embodiment based on the mode of operation of FIG. 9.

FIG. 12 illustrates a configuration wherein the dees are offset from each other in a manner similar to that of FIG. 11, and wherein the outer surfaces of the dees 14, 16 are provided with electrical insulation 70. The electrical insulation 70 shields ions moving in the space between the outside of the dees 14, 16 and the inside of the outer chamber 12 from the effects of the electrical charge on the dees 14, 16. That is, the insulation 70 prevents ions outside the dees 14, 16 from being electrically attracted to or repelled from the outer surface of the dees 14, 16. In addition, an electrically conductive material 72 may be provided on the outside of the insulation and maintained at zero electrical potential at all times (i.e., grounded). Also, the inside surfaces of the chamber 12 may also be of electrically conductive material and maintained at zero electrical potential, resulting in an approximately annular region which is essentially shielded or insulated from electrical fields resulting from charges on the dees 14, 16.

Figure 13:
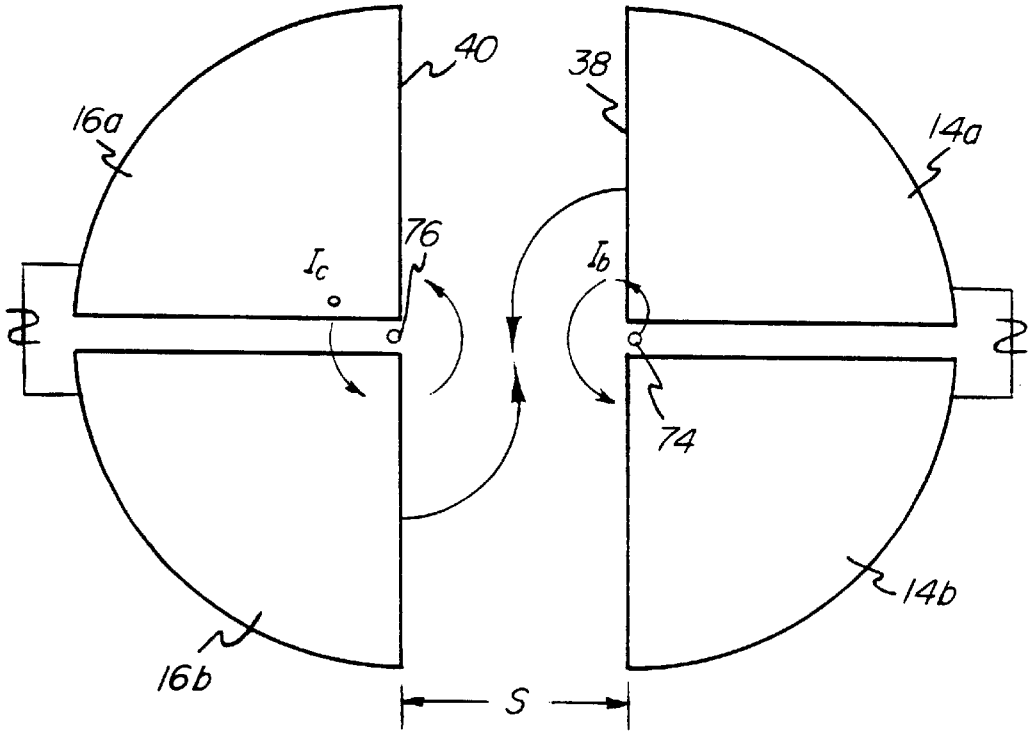
FIG. 13 is top plan view of a further embodiment of the present invention comprising two sets of half dees.
Figure 14:
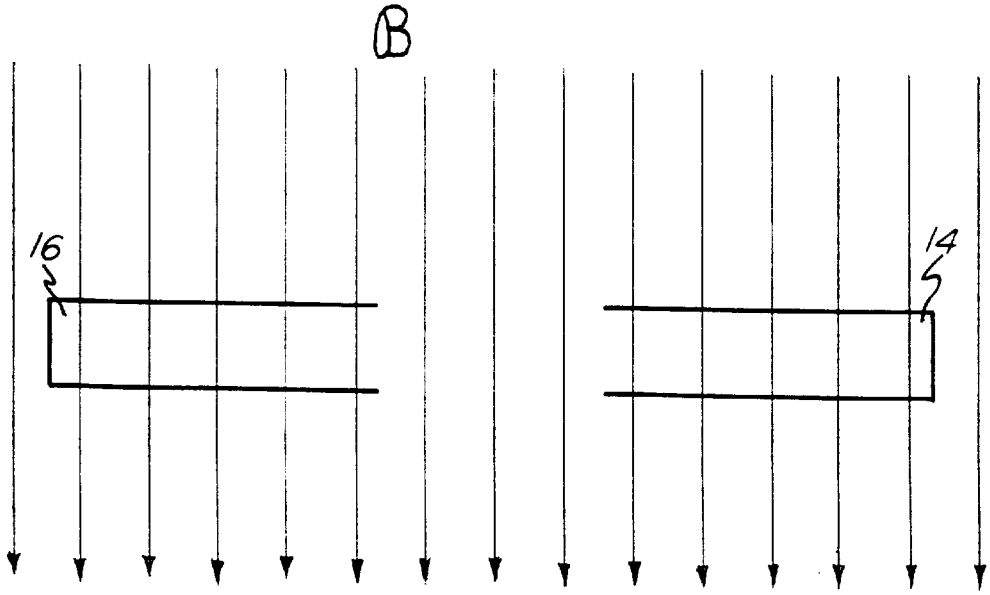
FIG. 14 is a side elevational view of the embodiment of FIG. 13.

Referring to FIGS. 13 and 14, an alternative configuration is illustrated for enhancing collisions between accelerated ions. As a general principle, the probability of deuteron—deuteron and similar reactions occurring increases as the deuteron energy or speed is increased. In accordance with the present invention, and in contrast to cyclotron operation, the particle accelerator herein described will operate with some ions following paths whose centers are not at the center of the apparatus. Thus, some ions in the present apparatus can undergo head-on collisions or near-head-on collisions which involve greater collision energy than the energy of either of the ions participating in the collision, with a resultant increase in the reaction probability. The configuration shown in FIGS. 13, and 14 enhances the probability of head-on and near-head-on collisions and comprises two right hand half dees 14*a*, 14*b* and two left hand half dees 16*a*, 16*b* wherein the half dees 14*a*, 14*b* are separated from the half dees 16*a*, 16*b* by a separation distance S, and a uniform magnetic field B is provided over the half dees 14*a*, 14*b*, 16*a*, 16*b* and through the separation distance S between the dees.

Figure 15:
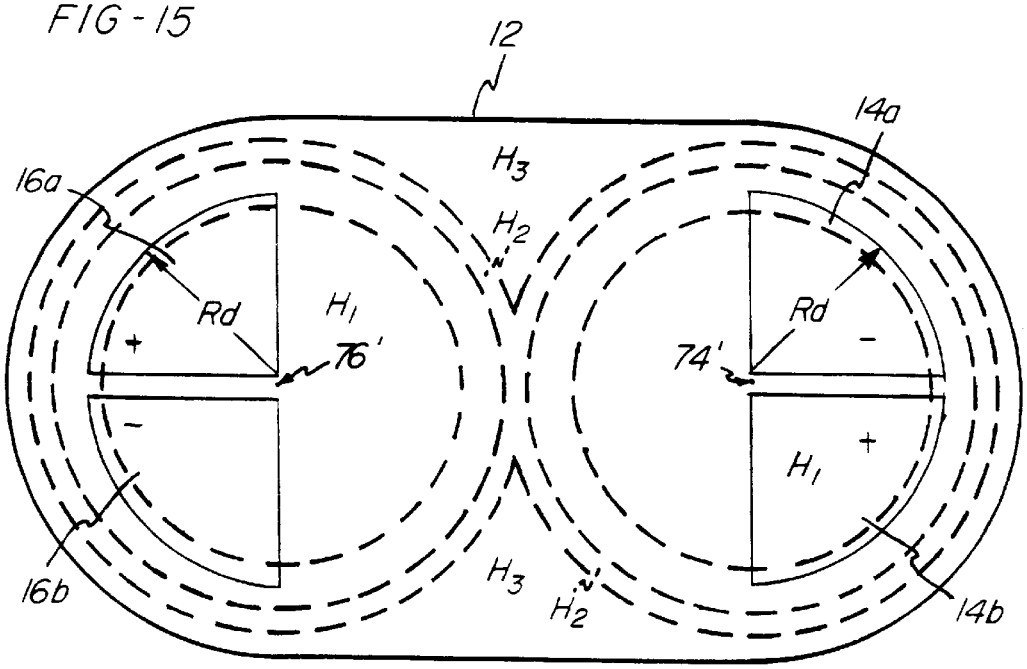
FIG. 15 is a top plan view of a further embodiment of the present invention comprising two sets of half dees and a varying magnetic field.

In operation, each of the half dee sets 14*a*, 14*b* and 16*a*, 16*b* are individually activated to accelerate ions about a respective center 74, 76 located at or near the front edges 38, 40 of the dees 14*a*, 14*b* and 16*a*, 16*b*. In particular, with reference to the half dees 16*a* and 16*b*, when an accelerating voltage is provided between the half dees 16*a*, 16*b* with the dee 16*a* being positive and the dee 16*b* being negative, and with an ion being generated at an ion generation location near the center point 76, an ion $I_c$ will move in a circular path down into the half dee 16*b*. As the ion $I_c$ moves into the dee 16*b*, the voltage between the half dees 16*a* and 16*b* is being reduced and reaches zero at the exact time that the ion $I_c$ leaves the half dee 16*b*. The ion $I_c$ continues to move in a circle within the separation region S, and the voltage between the half dees 16*a* and 16*b* is maintained at zero until the ion $I_c$ has traveled a one-half circle and enters the half dee 16*a*. At this time, the voltage is again applied across the half dees 16*a* and 16*b*, starting at zero and increasing to a maximum just as the ion $I_c$ crosses the gap between the two half dees 16*a* and 16*b*. This process is repeated with the ion $I_c$ moving in an increasingly larger radius. The opposing set of half dees 14*a*, 14*b* will accelerate ions originating at the point 74 in a similar manner such that an ion $I_b$ will follow a circular outwardly spiraling path through the half dees 14*a* and 14*b*. The separation distance S is selected such that it is at least slightly smaller than the radius of the dees such that the paths of the ions $I_b$ and $I_c$ will intersect at a central location between the half dee sets 14*a*, 14*b* and 16*a*, 16*b* with the collision energy being the combined energies of the ions $I_b$ and $I_c$ Referring to FIG. 15, a further embodiment of the present invention is illustrated which incorporates the concept of the previous embodiment of FIG. 13 and providing two sets of half dees 14*a*, 14*b* and 16*a*, 16*b* to accelerate particles about centers 74' and 76'. In addition, a configuration of FIG. 15 also incorporates the concept of FIGS. 9–12 in providing acceleration-free ion path configurations between the dees and the walls of the chamber. The present configuration provides a non-uniform magnetic flux extending into the plane of the paper, as seen in FIG. 15, and including two circular regions of radius $R_1$ in which the magnetic flux density is constant and uniform at a relatively high value $H_1$ (for example, 10,000 gauss). These regions have their centers at the same locations 74', 76' as are the centers of the two sets of the half dees. Extending outwardly from the radii $R_1$, the magnetic flux density decreases from $H_1$ to a lower value $H_2$ (for example, 7500 gauss), at radii of $R_2$. The radii $R_2$ are greater than the outside radii of the half dees 14*a*, 14*b* and 16*a*, 16*b*.

Between $R_2$ and a larger radius $R_3$, the flux density is constant at $H_2$, and at radius $R_3$, the magnetic flux density begins to increase and reaches a value $H_3$ at the radius $R_3$ wherein $H_3$ is greater than $H_2$.

It should be noted that the half dee 14*b* and half dee 16*a* are each quarter circles of inside radius $R_d$, with $R_1$ less than $R_d$ less than $R_2$, and with the centers of these half dees located at the same points 74', 76' as the centers of their respective regions of uniform flux $H_1$. Also, half dee 14*a* and half dee 16*b* are also quarter circles of radius $R_d$, but their centers are displaced from the centers of the uniform flux regions $H_1$. The amount of displacement of the half dees 14*a* and 16*b* is on the order of $(R_2-R_1)\div 2$ to somewhat less than $(R_2-R_1)$. Further, the magnetic flux density in regions outside of those bounded by $R_3$ preferably will increase from $H_2$ toward some value $H_3$ between $H_2$ and $H_1$ (for example, 8,000 gauss).

Ions will be generated or introduced mainly at the locations 74', 76', and ion acceleration in both pairs of half dees 14*a*, 14*b* and 16*a*, 16*b* will be counterclockwise, and is achieved by applying a half wave rectified accelerating voltage to both sets of half dees 14*a*, 14*b* and 16*a*, 16*b*. As the path radius of the ions accelerated by their respective half dees 14*a*, 14*b* and 16*a*, 16*b* reach a point that exceeds the radius $R_1$, the ion paths will spiral outwardly until their path radii exceed $R_2$, at which time they will again travel in a circular path of radius determined by their energy and the uniform magnetic flux $H_2$. This path is outside the dees 14*a*, 14*b* and 16*a*, 16*b*, and the radius is between $R_2$ and $R_3$.

The outside of the dees 14*a*, 14*b* and 16*a*, 16*b*, is insulated as described with regard to the embodiment of FIG. 12, and the spacing between the two sets of dees 14*a*, 14*b* and 16*a*, 16*b* is such that the $R_2$ to $R_3$ regions of the two sets of dees overlap in the central part of the apparatus. In the overlap region, ions with near machine maximum energy from the two sets of dees 14*a*, 14*b* and 16*a*, 16*b* may undergo near-head-on collisions, and since ions in these regions will continue traveling in the circular paths of constant radius until they have some interaction with another ion or atom, ions in these regions will have repeated opportunities for such head-on collisions, thereby enhancing reaction probability and operational efficiency.

A second enhancement to increase efficiency of this configuration relates to the "open" space between the two sets of half dees 14*a*, 14*b* and 16*a*, 16*b*. Ions in the acceleration-free zones (outside of the dees) which lose energy by means other than reaction-producing collisions in the open area have the possibility of re-entering the half dees and being re-accelerated. This is particularly true for ions which lose energy only by electron-field interaction, which tends to slow ions down without affecting their direction. Such ions would tend to re-enter the half dees with essentially circular paths centered near the center of a constant flux region and would have energies near the machine maximum. Such ions could be re-accelerated to machine maximum energy using only a small fraction of the energy which would be required to accelerate a newly created ion, and such ions would return to high energy without having to be re-accelerated through the low energy region where reactions are very unlikely, and where non-nuclear-reaction-producing interactions are relatively probable. Both aspects of the re-acceleration enhance both reaction production and efficiency of the apparatus.

Figure 16:
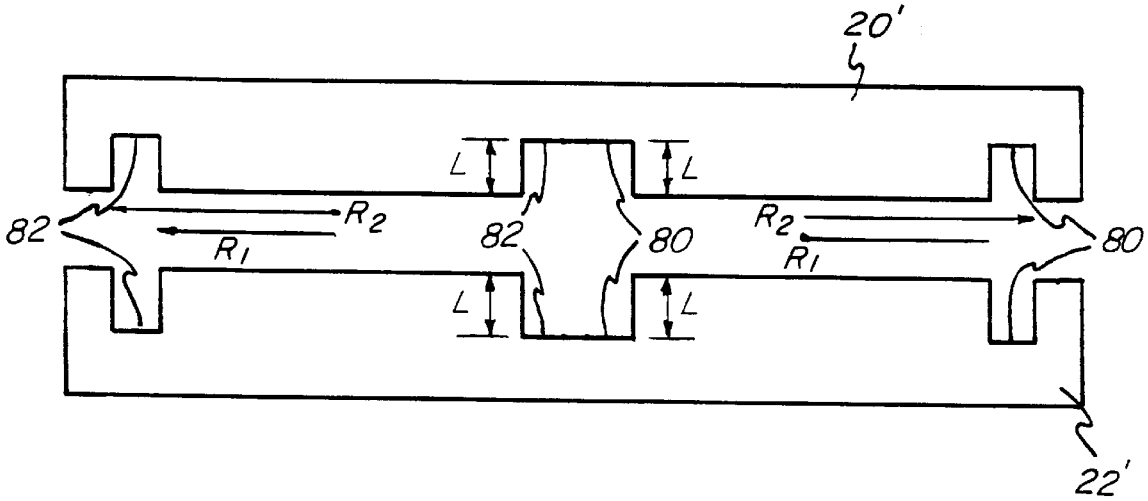
FIG. 16 is a side elevational cross-sectional view of magnetic poles for producing the magnetic field for the embodiment of FIG. 15.

In order to achieve the magnetic field variations described above, suitably located grooves in the faces of the pole pieces 20', 21' of the magnet may be provided. Specifically, referring to FIG. 16, circular grooves 80, 82 are machined into the flat faces of each pole 20', 21' concentric with the centers 74', 76' and having the inner edge of the groove essentially at radius $R_1$ and the outer edge essentially at radius $R_2$. The sides of the grooves are perpendicular to the pole faces, and the groove depth is L. The flux density between the poles will be relatively uniform inside the circle of radius $R_1$, but will begin to decrease at a radius somewhat less than $R_1$, continue to decrease as $R_2$ is passed and then (if the groove 80, 82 is wide enough) become essentially constant until nearing $R_3$. The flux density will start to increase as $R_3$ is crossed, and then will become constant with additional increases in radius. Of course, for narrow grooves, there will be no region of constant low flux density as the groove is crossed, only a minimum value at some point within the groove.

Alternatively, other forms of providing a sufficient reduction of flux density may be provided. For example, more sophisticated means of flux shaping, such as "flux shading" may be used.

From the above description, it should be apparent that the present invention provides a particle accelerator for inducing collisions between particles within the device. Further, while the present particle accelerator resembles a cyclotron, it differs substantially from a cyclotron in that the present device operates with a chamber filled with a gas at a measurable pressure, the gas comprising atoms forming targets for collision with accelerated ions. In addition, the present particle accelerator does not depend on limiting the accelerated ion path to be centered at the geometrical center of the device, but rather contemplates providing ions following paths with centers displaced from the geometrical center in order to provide an increased number of collisions between two accelerated particles, which is less likely to occur when all particles revolve about the same center point.

Further, in accordance with the broadest contemplated uses of the present invention, the accelerated ions preferably impact either deuterium or tritium atoms within the chamber to cause nuclear reactions and production of neutrons. An additional useful byproduct of such nuclear reactions is energy in the form of heat which may be extracted from the device for performing work in another device. Other useful applications of the present invention are also available and are not limited to those specifically described above.

While the forms of apparatus and methods of operation herein described constitute a preferred embodiment of this invention, it is to be understood that the invention is not limited to these precise forms of apparatus or methods, and that changes may be made therein without departing from the scope of the invention which is defined in the appended claims.

What is claimed is:

1. A particle accelerator comprising:

a contained chamber area comprising first and second portions;

each of said first and second portions formed of an electrically conductive material and comprising an upper surface and a lower surface, said upper and lower surfaces defining hollow chambers having open sides;

said first and second portions located adjacent to each other with said open sides facing each other and being electrically insulated from each other;

voltage means electrically connected to said first and second portions and providing a pulsed voltage to said first and second portions to provide an electrical field extending in a direction between said first and second portions;

a magnetic field passing generally perpendicular to said direction of said electrical field and passing through said contained chamber area;

an ion source in communication with said contained chamber area for providing ions to said contained area;

a substantial quantity of atoms at a measurable pressure contained within said contained chamber area for interaction with accelerated ions; and wherein said voltage means applies a voltage to said first and second portions to accelerate ions within said contained chamber area and in a direction generally parallel to said electrical field extending between said first and second portions, and said magnetic field exerts a directional force on ions moving within said contained chamber area to cause said ions to follow generally spiral paths and undergo repeated accelerations as they pass between said first and second portions within said contained chamber area, whereby high energy ions are provided for colliding with said atoms in said contained chamber area to cause nuclear reactions to occur within said contained chamber area between said ions and said atoms.

2. The apparatus of claim 1 wherein said first and second portions comprise hollow dee-shaped portions, each dee having an open side, and said open sides of said first and second portions facing each other to define a generally circular hollow area for containing ions being accelerated.

3. The apparatus of claim 1 wherein said first and second portions comprise opposing dee-shaped portions, each dee-shaped portion comprising a set of two half dees, said half dees of each set being electrically insulated from each other and said voltage means including means for providing a half wave pulsing voltage potential across said half dees of each set.

4. The apparatus of claim 1 including an electrode electrically connected to each of said first and second portions wherein an electrode of said first portion is spaced from an electrode of said second portion, such that an arcing is created between said electrodes when a voltage is applied by said voltage source to said first and second portions.

5. The apparatus of claim 2 wherein each of said dee-shaped portions defines a radius about a center point of each respective dee-shaped portion, said magnetic field comprising plural regions of constant magnetic flux density formed concentrically about each of said center points, each said region having a different constant magnetic flux density than a concentrically adjacent region.

6. The apparatus of claim 1 wherein said atoms comprise neutral atoms provided at a measurable pressure within said contained area.

7. The apparatus of claim 6 wherein said atoms comprise atoms selected from a group consisting of deuterium and tritium atoms.

8. A method of inducing collisions between particles comprising the steps of:

providing a contained area defining a chamber for containing a gas at a measurable pressure;

providing a pulsing voltage potential across at least a portion of said contained area wherein said voltage potential alternately changes at a predetermined frequency;

providing a magnetic field passing through said contained area generally perpendicular to said voltage potential;

providing ions to said contained area;

providing a substantial quantity of atoms at a measurable pressure within said contained area;

accelerating said ions through said voltage potential within said contained area wherein said magnetic field causes said ions to follow a generally spiral path which is generally parallel to a plane defined by said electrical field and perpendicular to said magnetic field, said ions being repeatedly accelerated through said voltage potential as said voltage potential pulses at said predetermined frequency; and wherein said ions collide with said atoms to cause nuclear reactions between said ions and said atoms within said contained area.

9. The method of claim 8 wherein said collisions of ions with atoms produce neutrons.

10. The method of claim 8 wherein said collisions of ions with atoms comprise collisions of ions with neutral atoms.

11. The method of claim 10 wherein said collisions of ions with neutral atoms produce additional ions within said contained area.

12. The method of claim 11 further including the step of accelerating said additional ions through said voltage potential.

13. The method of claim 8 wherein a plurality of said ions are accelerated through said voltage potential and at least some of said plurality of said ions follow paths which are non-concentric with the paths of others of said ions whereby collisions between accelerated ions are produced to cause nuclear reactions to be produced.

14. The method of claim 8 including the step of extracting energy in the form of heat from said contained area for performing work in another device.

15. The method of claim 8 including opposing, hollow dee-shaped members positioned in facing relationship to each other and applying a pulsing voltage to said dee-shaped members, and wherein ions are accelerated about points within said contained area which are non-concentric with said dee-shaped members.

16. The method of claim 8 including opposing dee-shaped portions, each said dee-shaped portion comprising a set of two half dees electrically separated from each other, and each set of half dees has a half wave pulsing voltage applied to it whereby each dee-shaped portion accelerates ions separately from the other dee-shaped portion between a respective set of half dees.

17. The method of claim 16 wherein said dee-shaped portions are separated by a predetermined distance whereby ions accelerated by the set of half dees forming one dee-shaped portion will collide with ions accelerated by the set of half dees forming the other dee-shaped portion after the ions accelerated by each dee-shaped portion reach a predetermined minimum energy.

18. The method of claim 8 including opposing, hollow dee-shaped members positioned in facing relationship to each other and applying pulsing voltage to said dee-shaped members, and including the step of causing ions accelerated to an outer peripheral wall of the dees to pass to a region radially outside of the dees within the contained area and follow a substantially constant radius path until colliding with an atom.

* * * * *